US009327951B2

(12) United States Patent
Doyle

(10) Patent No.: US 9,327,951 B2
(45) Date of Patent: May 3, 2016

(54) DRIVE SYSTEM FOR TELESCOPIC LEGS FOR TABLES

(75) Inventor: James E. Doyle, Grandville, MI (US)

(73) Assignee: Suspa GmbH (DE)

( * ) Notice: Subject to any disclaimer, the term of this patent is extended or adjusted under 35 U.S.C. 154(b) by 920 days.

(21) Appl. No.: 13/459,414

(22) Filed: Apr. 30, 2012

(65) Prior Publication Data

US 2012/0286221 A1 Nov. 15, 2012

Related U.S. Application Data

(60) Provisional application No. 61/483,955, filed on May 9, 2011.

(51) Int. Cl.

| | |
|---|---|
| ***B66F 3/08*** | (2006.01) |
| ***B66F 3/42*** | (2006.01) |
| ***A47B 9/10*** | (2006.01) |

(52) U.S. Cl.

CPC .... *B66F 3/42* (2013.01); *A47B 9/10* (2013.01)

(58) Field of Classification Search

CPC ..... A47B 9/10; B66F 3/42; B66F 3/24; B66F 3/08; B66F 3/10

USPC ..... 254/98, 102, 93 A; 92/136, 116, 261; 60/400

See application file for complete search history.

(56) References Cited

U.S. PATENT DOCUMENTS

| | | | | |
|---|---|---|---|---|
| 2,952,143 | A * | 9/1960 | Case | 464/88 |
| 3,640,502 | A | 2/1972 | Bargman, Jr. | |
| 3,865,500 | A * | 2/1975 | Newell | F16D 1/104 16/422 |
| 3,904,177 | A * | 9/1975 | Dalton | 254/103 |
| 4,133,411 | A | 1/1979 | Curb | |
| 4,137,784 | A * | 2/1979 | Griffin | 74/89.37 |
| 4,161,891 | A * | 7/1979 | Bossert | 74/548 |
| 4,837,873 | A | 6/1989 | DiMatteo et al. | |
| 4,952,078 | A * | 8/1990 | Ankenbauer et al. | 384/476 |
| D336,233 | S * | 6/1993 | Zimmermann | D8/309 |
| 5,371,919 | A * | 12/1994 | Winkler | 16/422 |
| 5,553,550 | A | 9/1996 | Doyle | |
| 5,601,037 | A * | 2/1997 | Meyer et al. | 108/147 |
| 5,809,908 | A * | 9/1998 | Catta | A47B 9/12 108/147 |
| 6,352,037 | B1 * | 3/2002 | Doyle | 108/20 |
| 6,386,528 | B1 * | 5/2002 | Thorn et al. | 267/201 |
| 6,595,144 | B1 | 7/2003 | Doyle | |

(Continued)

OTHER PUBLICATIONS

Search Report from EPO on corresponding application, Jul. 26, 2012.

*Primary Examiner* — Lee D Wilson
*Assistant Examiner* — Henry Hong
(74) *Attorney, Agent, or Firm* — Price Heneveld LLP

(57) ABSTRACT

A hydraulic drive system readily adapted for either manual actuation or motor-driven actuation due to the unique design of the hydraulic drive and its coupling to either a hand crank or to a motorized drive to provide hydraulic pressure to lift cylinders that can be attached to table legs for vertical adjustment. The hydraulic drive includes a screw jack having an end extending from one end of a housing and splined or otherwise keyed. A manual crank arm or motorized drive assembly includes a coupling which mates with the end of the screw jack to provide a drive force for the hydraulic cylinder drive. The motorized drive assembly includes a pair of toothed hubs and an intermediate flexible sleeve allowing alignment of the motorized drive to the drive assembly as well as providing sound dampening, a cushioned coupling, and facilitates overcurrent detection.

6 Claims, 12 Drawing Sheets

(56) References Cited

U.S. PATENT DOCUMENTS

| | | | | |
|---|---|---|---|---|
| 6,705,239 | B2 | 3/2004 | Doyle | |
| 6,711,985 | B1 | 3/2004 | Doyle | |
| 7,246,779 | B2 | 7/2007 | Doyle | |
| 7,484,713 | B1 | 2/2009 | Young | |
| 7,748,308 | B2 * | 7/2010 | Anderson et al. | 91/61 |
| 2002/0071751 | A1 | 6/2002 | Brice et al. | |
| 2005/0109996 | A1 * | 5/2005 | Razzaghi | 254/126 |
| 2006/0264076 | A1 * | 11/2006 | Chen | 439/82 |
| 2007/0018145 | A1 * | 1/2007 | Wang | 254/126 |
| 2008/0149358 | A1 | 6/2008 | Catlin | |
| 2009/0065752 | A1 * | 3/2009 | Doyle | 254/93 R |

* cited by examiner

DRIVE SYSTEM FOR TELESCOPIC LEGS FOR TABLES

CROSS-REFERENCE TO RELATED APPLICATIONS

This application claims priority under 35 U.S.C. §119(e) and the benefit of U.S. Provisional Application No. 61/483,955 entitled Drive System for Telescopic Legs for Tables, filed on May 9, 2011, by James E. Doyle and Andrew J. Brouwers, the entire disclosure of which is incorporated herein by reference.

BACKGROUND OF THE INVENTION

The present invention relates to an improved manual or motor-driven hydraulic drive system for telescopic legs for a table or other apparatus to be vertically movable.

Telescopic legs for adjusting the height of a work surface, such as a table, has become increasingly popular as attempts are made to improve the work environment and provide better working conditions for employees. Thus, adjustable height work surfaces accommodate employees that are either standing or sitting and are of different gender and/or stature. U.S. Pat. Nos. 6,705,239 and 7,246,779, both assigned to the present Assignee, disclose adjustable table legs which utilize hydraulic cylinders to provide vertically adjustable work surfaces. Lift systems which include hydraulic cylinders and electrically driven pumps are sold by Suspa Incorporated, the Assignee of the present invention, under the trademark MOVOTEC®. Such systems allow the retrofitting of table legs with attachable cylinders to provide manual or electrical raising and lowering of tables. The MOVOTEC® brand leg systems, however, cannot be easily converted from a manual crank system to an electrically driven system and, thus, require separate and distinct drive systems.

SUMMARY OF THE INVENTION

The system of the present invention, however, utilizes a hydraulic drive system which is readily adapted for either manual actuation or motor-driven actuation due to the unique design of the hydraulic drive and its coupling to either a hand crank or to a motorized drive. With such a system, therefore, a single hydraulic drive can be employed with either a manually actuated crank arm or an electrically driven motor to provide hydraulic pressure to lift cylinders that can be integral with or attached to table legs or other apparatus for vertical adjustment.

In the preferred embodiment of the invention, the system is a hydraulic drive with a screw jack, having an end extending from one end of a housing and splined or otherwise keyed. In a first embodiment of the invention, a manual crank arm includes a coupling which mates with the end of the screw jack. In another embodiment of the invention, a motorized drive unit includes a motor-driven coupling which likewise mates with the end of the screw jack to provide a drive force for the hydraulic cylinder drive. In a preferred embodiment of the invention, the motorized coupling includes a pair of toothed hubs and an intermediate flexible sleeve coupling allowing alignment of the motorized drive to the drive assembly as well as providing sound dampening and a cushioned coupling. This also facilitates overcurrent detection by preventing sharp overcurrent condition and provides a more gradual current curve with which to operate. Thus, with the system of the present invention, a single hydraulic drive can be provided and universally receives either a hand crank assembly or a motorized drive assembly for the actuation of lift cylinders that can be used for raising and lowering work surfaces or other apparatus.

These and other features, objects and advantages of the present invention will become apparent upon reading the following description thereof together with reference to the accompanying drawings.

DETAILED DESCRIPTION OF THE PREFERRED EMBODIMENT

Figure 1:
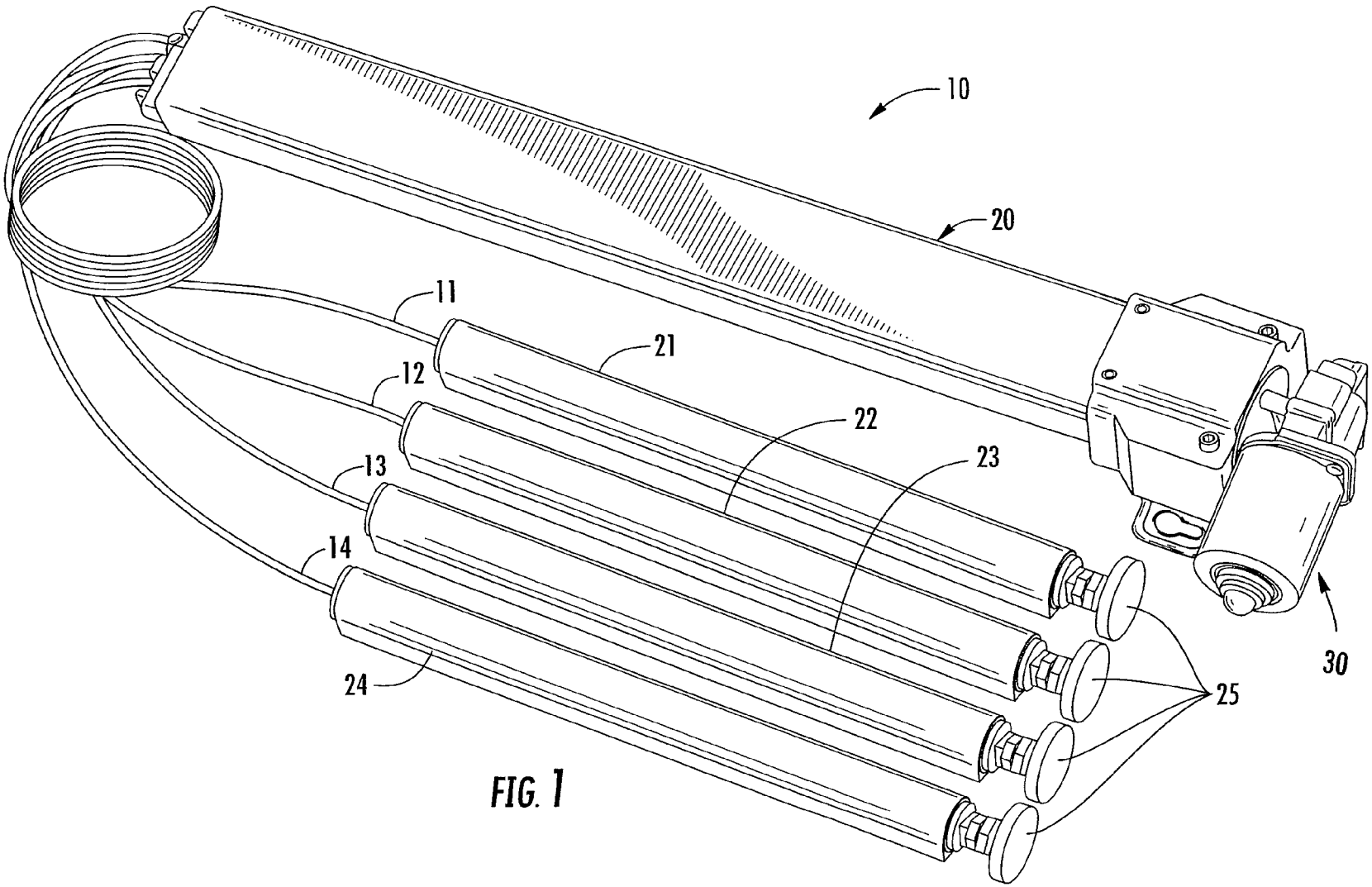
FIG. 1 is a perspective view of a motorized leg lift kit including a hydraulic drive and leg assemblies for attaching to legs of a table or work surface.
Figure 2:
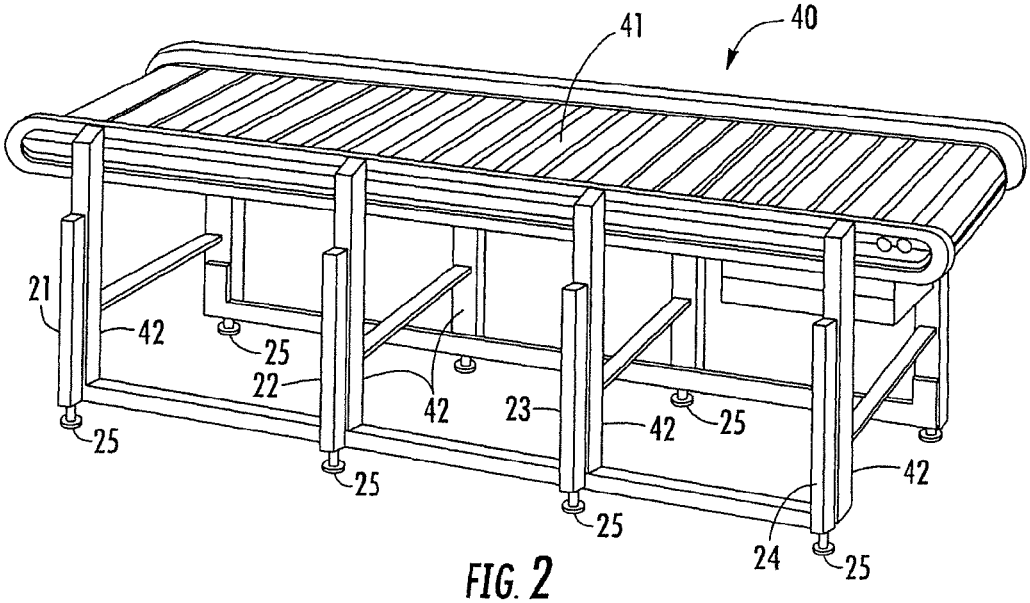
FIG. 2 is a perspective view of a work surface, shown with the lift cylinders secured thereto and in a lowered or retracted position.
Figure 3:
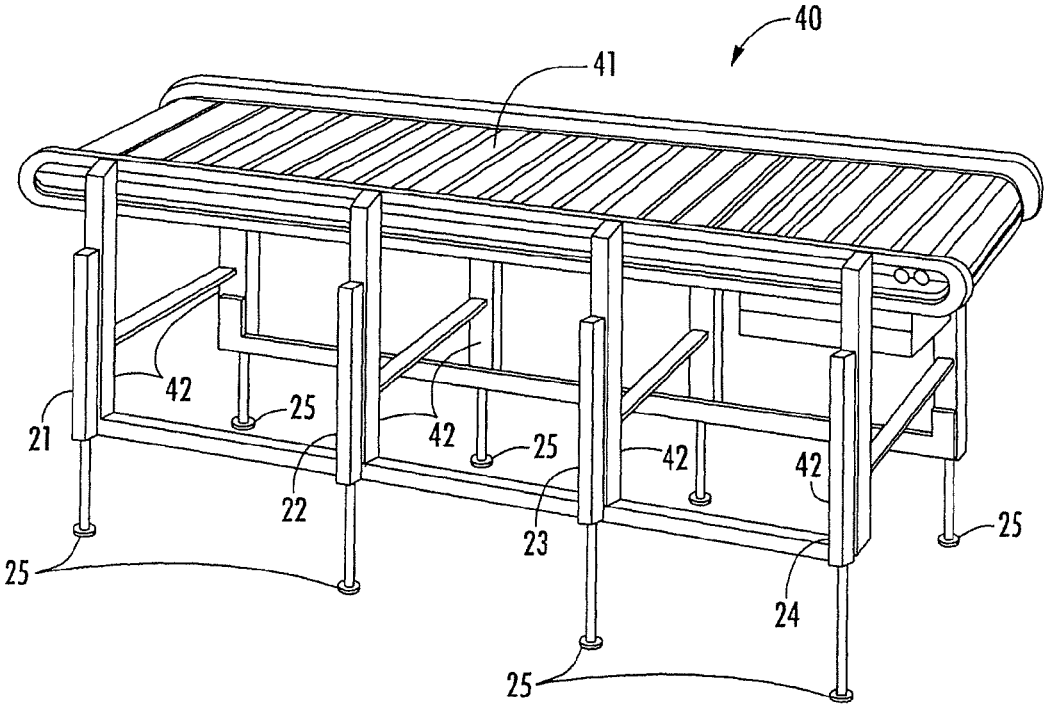
FIG. 3 is a perspective view of the structure shown in FIG. 2, shown in a raised cylinder extended position.

Referring initially to FIG. 1, there is shown a kit 10 for raising and lowering a work surface, such as 40 illustrated in FIGS. 2 and 3. The kit comprises a motorized hydraulic drive unit 20 including a drive motor assembly 30 which controls a screw jack for pressurizing hydraulic cylinders within the hydraulic drive 20 providing hydraulic pressure through tubes 11-14 to hydraulically actuated cylinders 21-24, respectively, which form bolt-on legs with extendable foot pads 25. Cylinders 21-24 can be secured to the legs of a work surface, such as fixed legs 42 of work surface 40 as shown in FIGS. 2 and 3. The construction of cylinders 21-24 can be substantially the same as that disclosed in U.S. Pat. No. 6,711,985, entitled Sealed Glide Adapter, issued Mar. 30, 2004, the disclosure of which is incorporated herein by reference. For the eight-legged work surface 40 shown in FIGS. 2 and 3, two kits 10 are employed for moving the work surface 40 from a lowered position, shown in FIG. 2, to a raised position, shown in FIG. 3, and positions intermediate depending on the desired vertical height of the upper surface 41 of the work surface or table 40.

Figure 9:
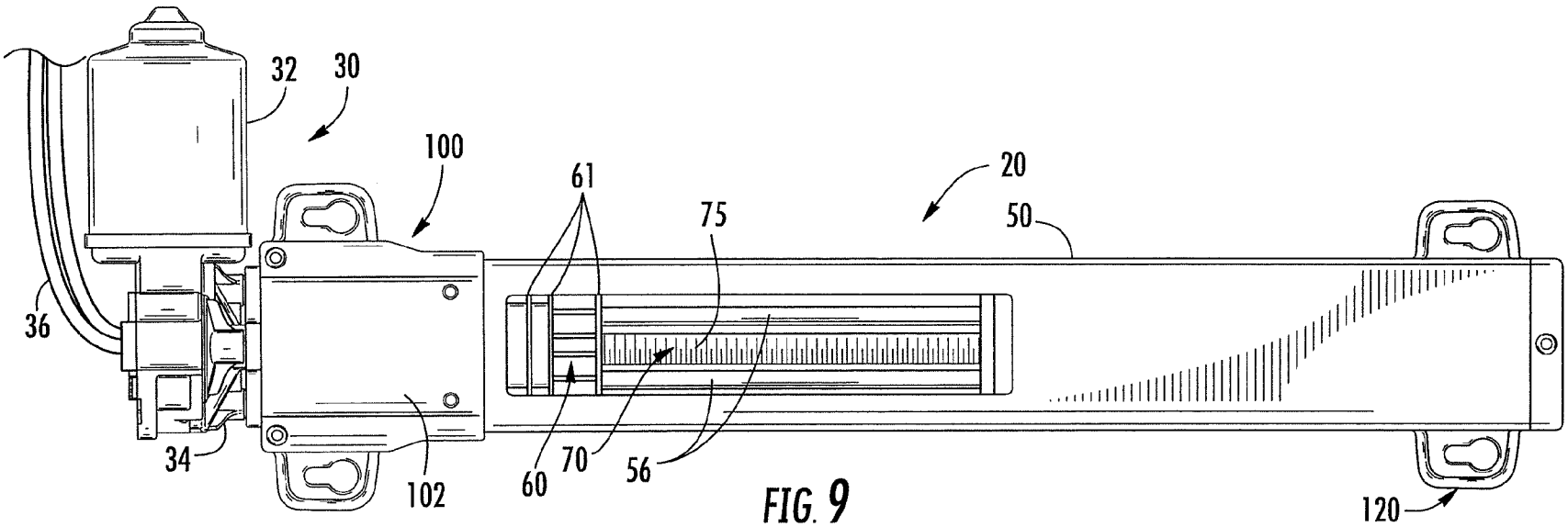
FIG. 9 is a top elevational view, partly broken away, of a motorized hydraulic drive assembly.
Figure 10:
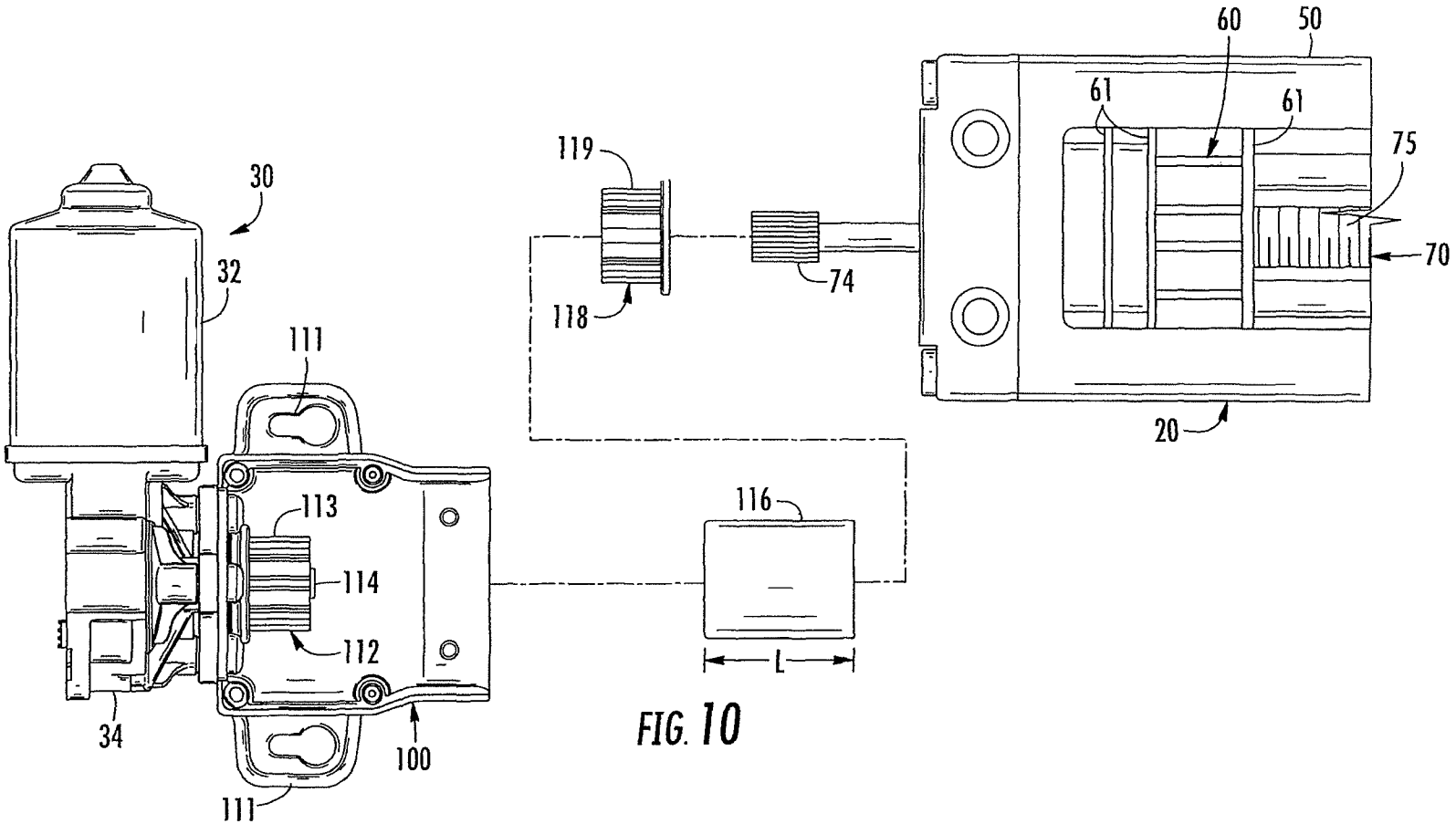
FIG. 10 is a fragmentary exploded view of the assembly shown in FIG. 9.
Figure 11:
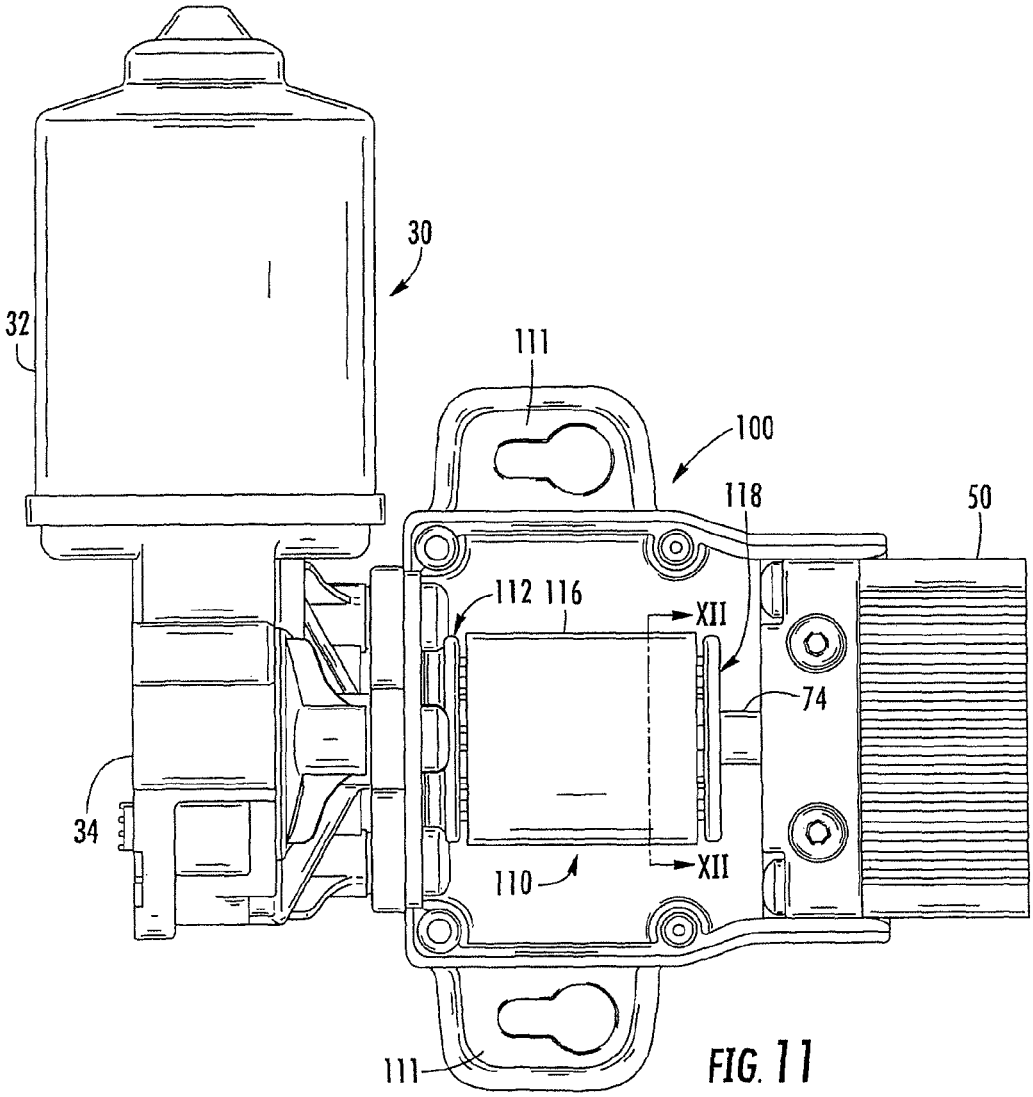
FIG. 11 is an enlarged assembled fragmentary top elevational view of the drive motor and coupling to the hydraulic drive shown in FIG. 10.
Figure 12:
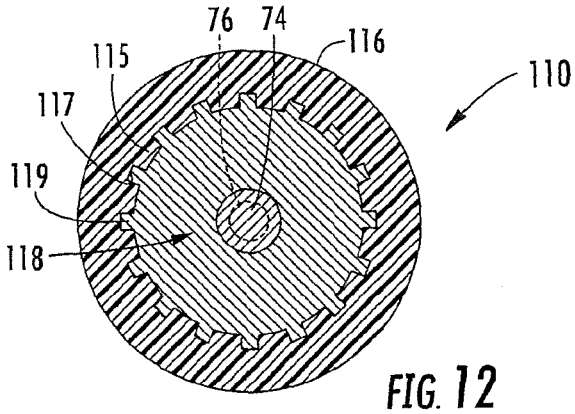
FIG. 12 is a cross-sectional view of the coupling shown in FIG. 11, taken along section line XII-XII.
Figure 13:
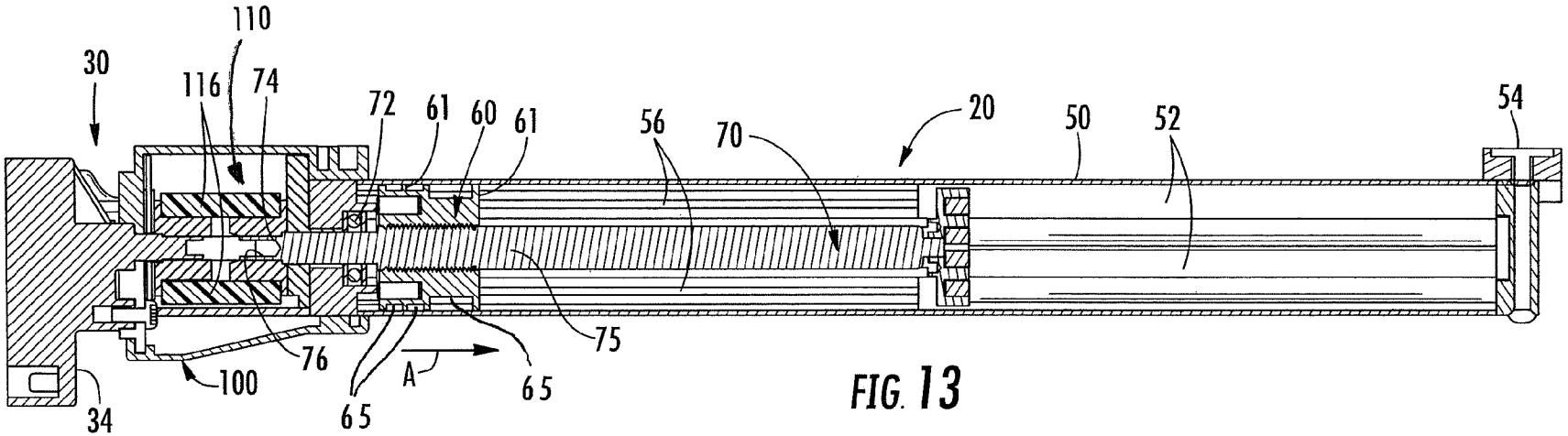
FIG. 13 is a cross-sectional view of the drive motor, coupling, and hydraulic drive shown in FIGS. 10 and 11.
Figure 14:
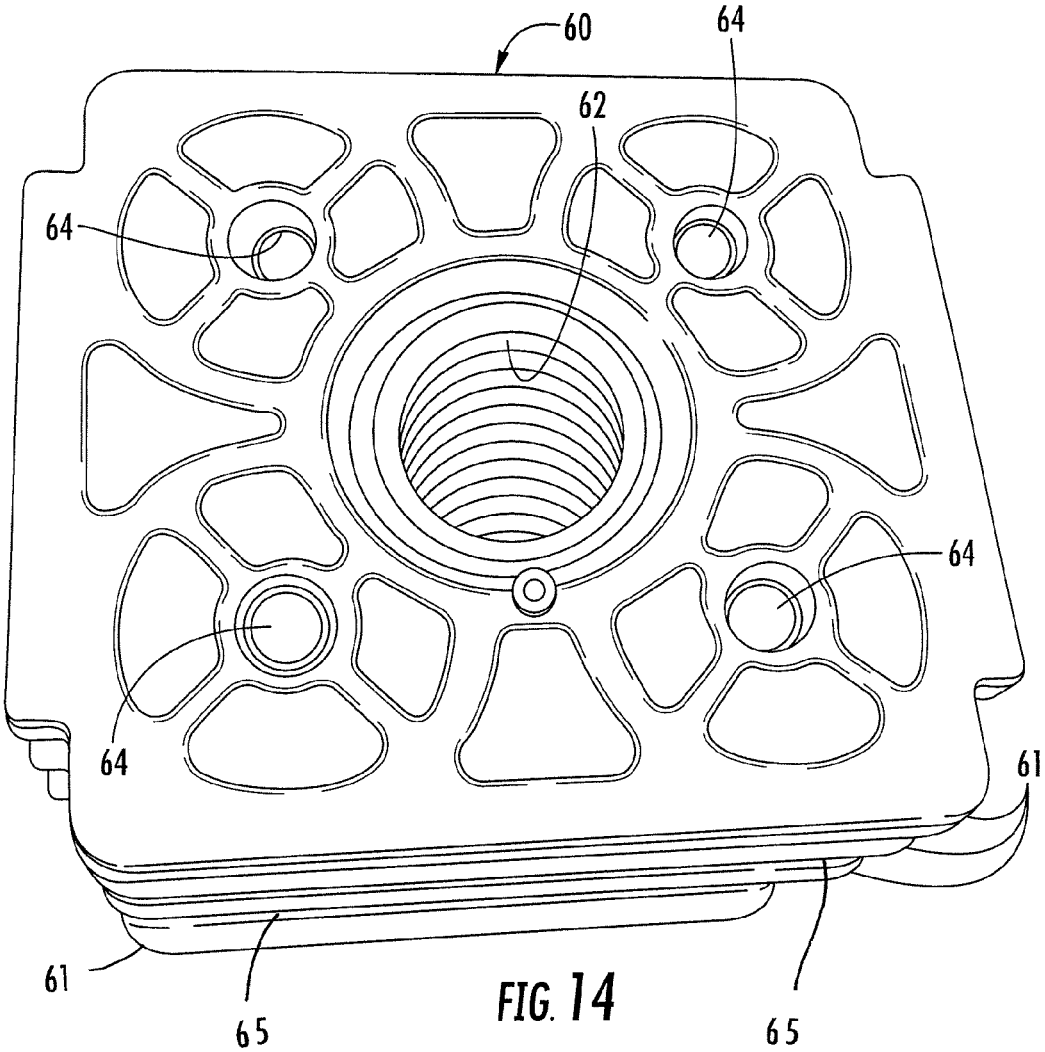
FIG. 14 is a left end perspective view of the drive block for the hydraulic drive seen in FIGS. 7 and 9.

The hydraulic drive 20, as best seen in FIGS. 9 and 13, is the same one used in both the mechanical crank arm version (shown in FIGS. 4-8) as well as the electrically driven version (shown in FIGS. 9-14). Drive unit 20 comprises a generally rectangular extruded aluminum housing 50 for securing in spaced relationship therewith four hydraulic cylinders 52, which provide pressurized hydraulic fluid at four outlets 54 to tubes 11-14 for cylinders 21-24, respectively. The piston rods 56 for hydraulic cylinders 52 have one end anchored into the thrust nut 60 which is slideably mounted within housing 50 and includes an internal thread 62 (FIG. 14) engaging the screw jack 70, which is supported by a bearing 72 and includes an extended end 74 (FIGS. 7 and 10) which is keyed or splined to engage a coupling for either the mechanically driven system or the electrically driven system as described below. The thrust nut 60 is shown in FIG. 14 and described in greater detail below. Rotation of screw jack 70 causes thrust nut 60 to move from the left to the right, as illustrated in FIG. 12, pushing piston rods 56 (and pistons associated therewith) into cylinders 52, thereby applying hydraulic pressure to lines 11-14 for extending pads 25 and raising the work surface 41 to a raised position, as shown in FIG. 3. Rotating the screw jack 70 in the opposite direction reduces the pressure, allowing the cylinders 21-24 to contract pads 25 into a lowered position, as shown in FIG. 2. Hydraulic drive 20 may be actuated by an electrical motor assembly 30 (FIGS. 1 and 9-13) or by a manual crank arm assembly 80 as now described in connection with FIGS. 4-8.

Figure 4:
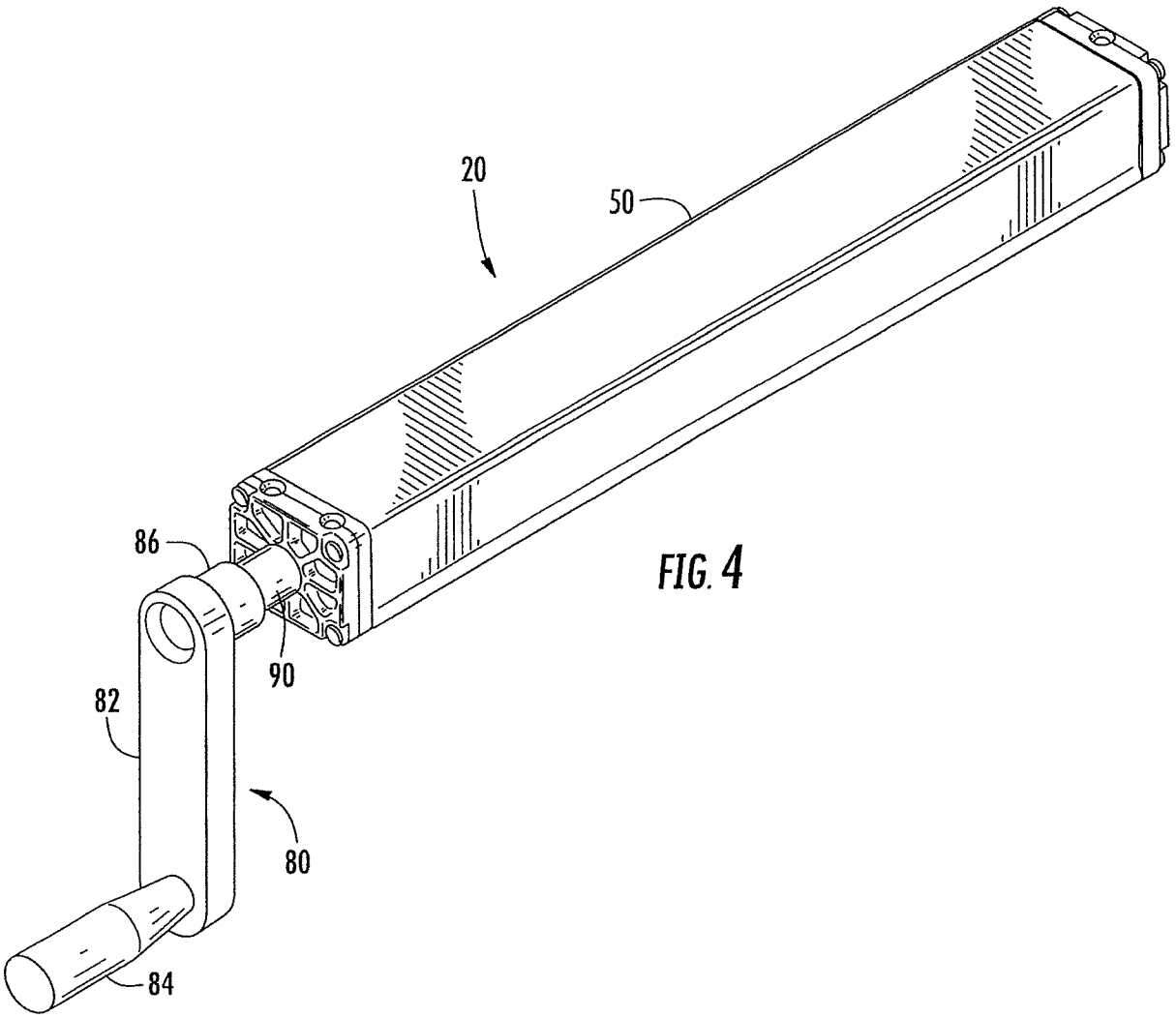
FIG. 4 is a perspective view of a hydraulic drive which is mechanically actuated by a crank arm.
Figure 5:
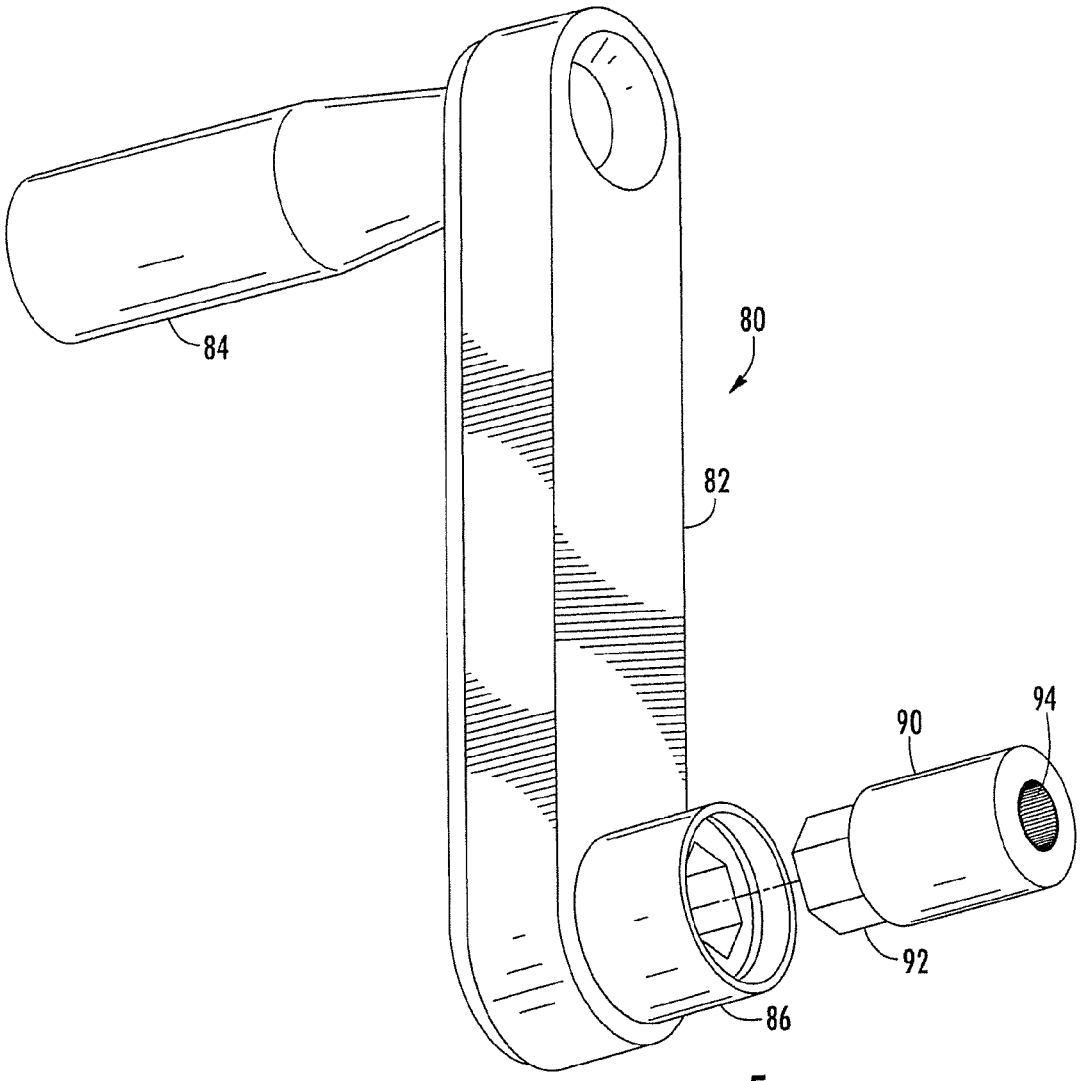
FIG. 5 is an enlarged perspective view of the crank arm and coupler for mechanically attaching the crank arm to the hydraulic drive.
Figure 6:
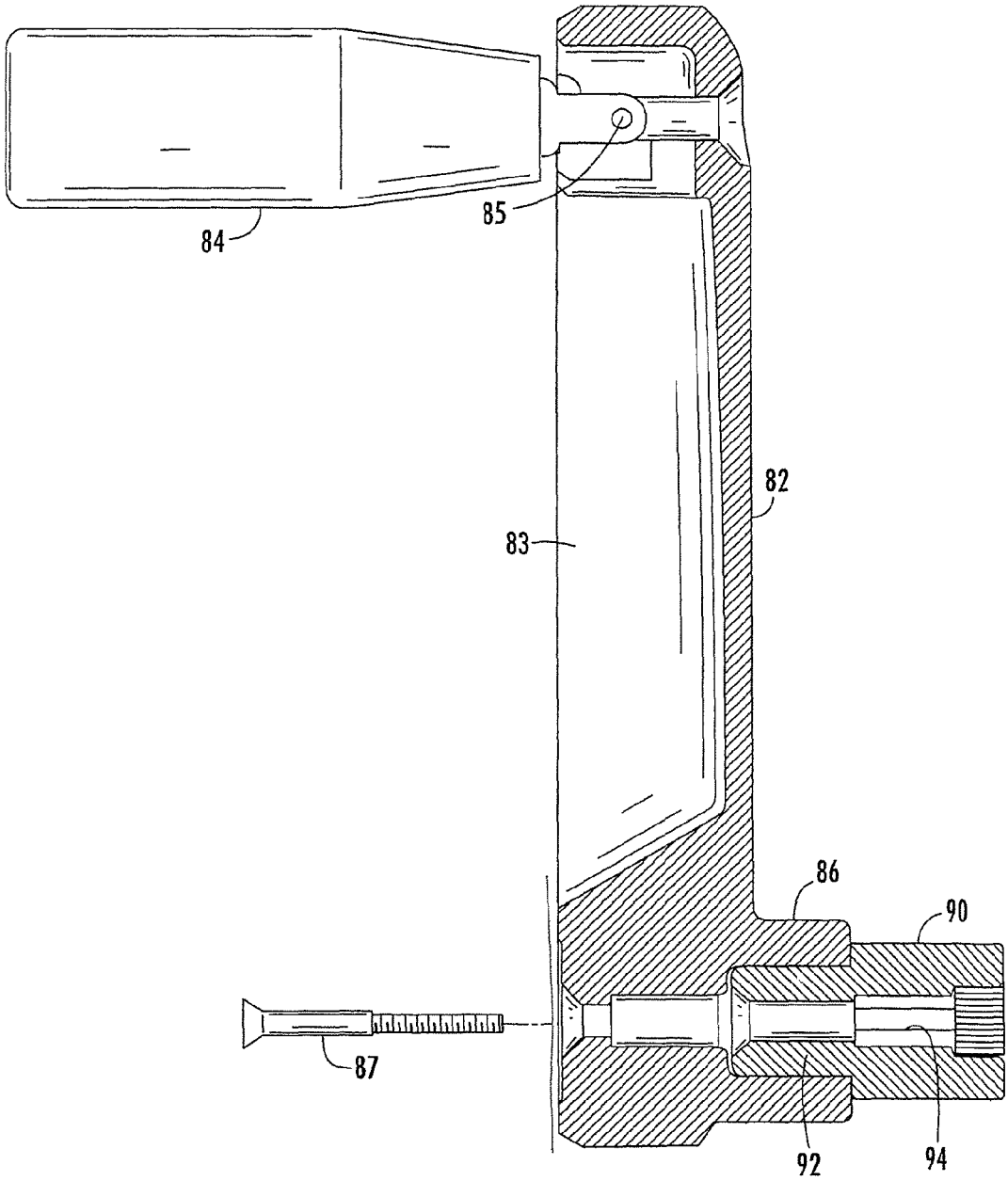
FIG. 6 is an enlarged cross-sectional view of the crank arm and coupling.
Figure 7:
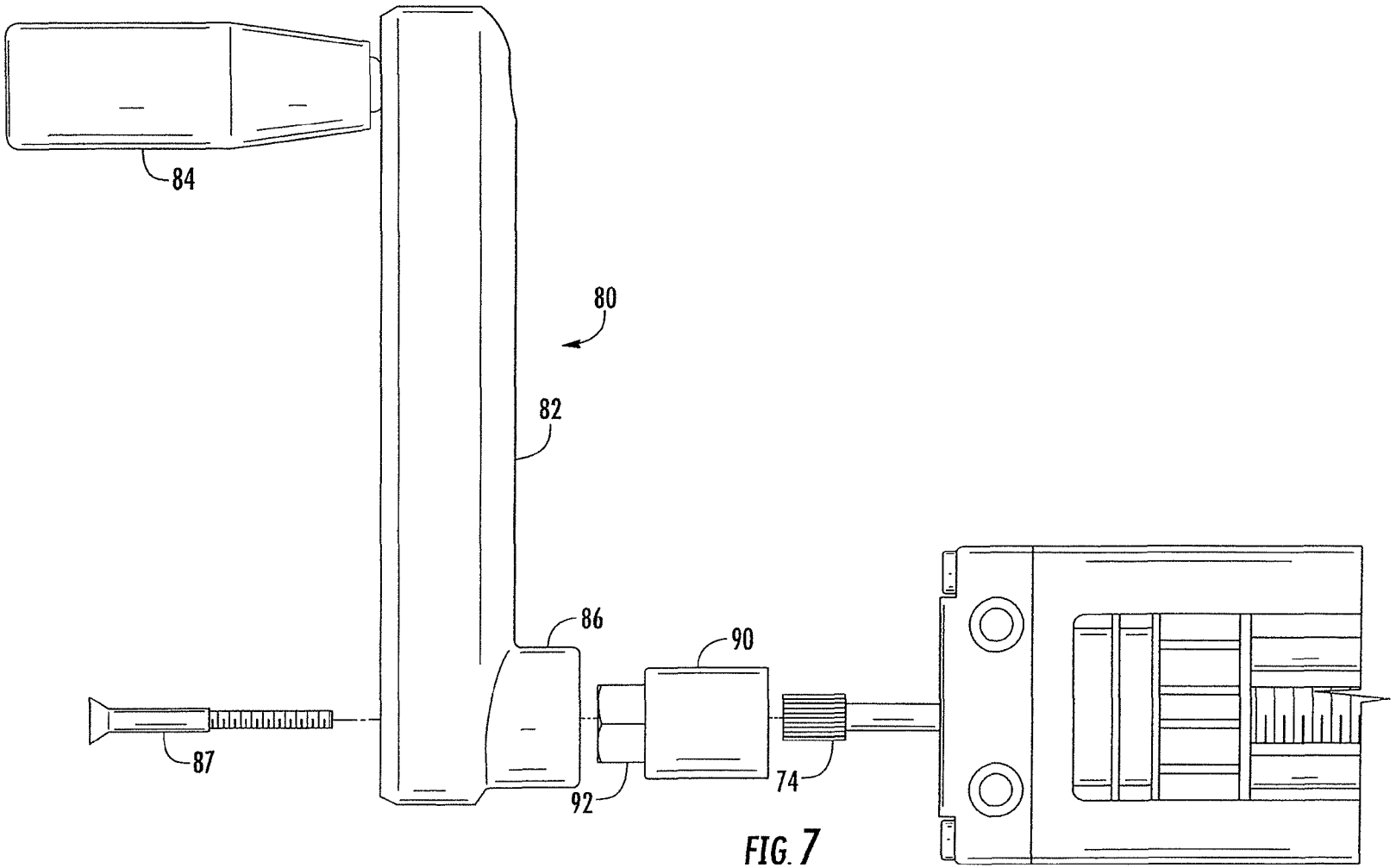
FIG. 7 is an exploded view of the crank arm coupling and end of the hydraulic drive.
Figure 8:
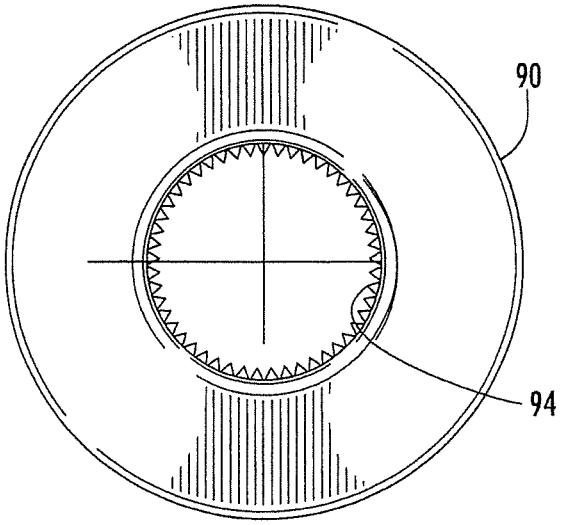
FIG. 8 is a right end elevational view of the coupling shown in FIG. 7.

Crank arm assembly 80 comprises a crank arm 82 having a foldable handle 84 which folds into the crank arm and a drive hex socket 86 on the end opposite handle 84. The collapsible handle is pivotally mounted to arm 82 at 85 and pivots into a pocket 83, as best seen in FIG. 6. Socket 86 receives a coupler 90 which has a hex head 92 that fits within the hex socket 86 and is held therein by means of an attachment fastener, such as screw 87 (FIGS. 6 and 7). Coupler 90 has an end opposite hex head 92 with a splined aperture 94 (FIGS. 5, 6, and 8) which mates with and positively engages the splined end 74 of screw jack 70. Crank arm assembly 80 is assembled onto the hydraulic drive 20, as illustrated in FIG. 4, and held thereon by the fastening screw 87 which, as seen in FIG. 7, extends through socket 86, coupler 90, and into a threaded aperture 76 (FIGS. 12 and 13) in the extending end 74 of screw jack 70. Thus, in the embodiment shown in FIGS. 4-8, the hydraulic drive 20 is controlled by the crank arm assembly 80, which is secured to the splined end 74 of screw jack 70 extending from housing 50 of the hydraulic drive 20. The splined end 74 may otherwise be keyed to the coupler 90 in another manner other than by the spline connection, which, however, is preferable. The handle is held in place to the hydraulic drive 20 by means of the fastener 87 extending axially through the socket 86, coupler 90, and into the end 74 of screw jack 70 but can be easily removed and stored when not in use.

Coupler 90 can also be assembled directly to splined shaft 74 by means of a fastener 87. The hex head 92 of assembled coupler 90 can then be driven using a hex socket driven by an electric drill or screwdriver with an integral clutch to prevent pump overdrive. Alternatively, the coupler can be driven utilizing a conventional wrench or ratchet drive with a socket that mates with end 92 of coupler 90.

In the electrically driven version, the hydraulic drive 20 is identical, including the splined end 74 of screw jack 70, but is coupled to the motor assembly 30 utilizing a coupling housing and coupling structure best seen in FIGS. 10 and 11. Motor assembly 30 includes a conventional, electrically driven motor 32, and right angle gear box 34. Motor 32 is actuated by an electrical control circuit coupled to the motor 32 by means of conductors 36, which lead to a control circuit sensing the current draw of motor and turning the motor off when an overcurrent is sensed, indicating that the end of travel of the screw jack 70 and piston rods 56 for cylinders 52 has been reached in a conventional manner employed in existing MOVOTEC® brand lift systems. The addition of flexible coupling assembly 110 (FIG. 11) facilitates the overcurrent detection as the flexible coupling prevents a sharp overcurrent condition and provides a more gradual current curve with which to operate. The gear box 34 is mounted to a coupling housing 100, as best seen in FIGS. 9-13, which includes a cover 102 (FIG. 9) for coupling assembly 110 once installed to couple the output shaft of gear box 34 to the screw jack 70.

Coupling assembly 110 (FIGS. 10-12) includes a pair of hubs 112, 118 which are coupled by a flexible coupling sleeve 116. Hub 112 is secured to the end of drive shaft from gear box 34 by means of a fastening screw 114. Hub 112 includes a plurality of arcuately spaced teeth 113 projecting outwardly therefrom around the periphery and which mate within slots 117 formed in a flexible coupling sleeve 116 which has a length L (FIG. 10) greater than the lengths of hubs 112 and 118. The second or driven hub 118 is mounted to the splined end 74 of hydraulic drive 20 and includes a splined center aperture and is held thereto by means of a similar fastening screw threaded into the threaded aperture 76 of splined end 74 of screw jack 70. Hub 118 includes teeth 119 similar to teeth 113 of hub 112 and has a thickness or axial length less than half the length L of flexible coupling sleeve 116, such that, when assembled as shown in FIGS. 11 and 13, hubs 112 and 118 do not touch. They lockably engage one another through their engagement with internal slots 117 and adjacent teeth 115 of flexible coupling sleeve 116. The coupling 110 itself, used for a different purpose in a different environment, can generally be of the type disclosed in U.S. Pat. No. 2,952,143, the disclosure of which is incorporated herein by reference.

Coupling 110 provides sound damping between the motor and the hydraulic drive, cushioning between motor assembly 30 and hydraulic drive 20, as well as allow more gradual overcurrent detection for the motor. It also provides easy connection of the motor assembly 30 to the hydraulic drive 20. Flexible coupling sleeve 116 can be made of a suitable and durable material, such as neoprene, to provide the desired coupling characteristics between the output shaft of gear box 34 and the input of end 74 of screw jack 70.

Housing 100 includes mounting tabs 111 for mounting the motor end of the system to a suitable location on a work surface or table while the opposite end includes a similar mounting bracket 120 (FIG. 9) for stabilizing the opposite end and mounting it to the table. The hydraulic drive 20 includes an improved, more robust thrust nut 60, shown in FIGS. 13 and 14, which is made of an acetal, such as Delrin®, and provides a drive block for the four cylinder piston rods 56 associated with four cylinders 52. The thrust nut or drive block 60 includes central threaded aperture 62, which is threadably engaged by the threads 75 of screw jack 70, such that rotation of the screw jack moves the block 60 in the direction indicated by arrow A in FIG. 13. Counter rotation of the drive shaft from gear box 34 provides the opposite motion. The four piston rods 56 are inserted in four circular sockets on the side of block 60 opposite that shown in FIG. 13 and are held therein by means of a press-fit connection to each of the four recessed apertures 64 associated with the piston rods 56. If it is necessary to replace any one of the cylinders 52, the piston rods can be pushed from block 60 utilizing the apertures 64 as an access port. Drive block 60 includes a plurality of axially spaced ribs 61, with grooves 65 between them, which minimizes the friction of the pusher block within the extruded housing 50 of hydraulic unit 20 when motor assembly 30 is actuated to provide a smooth and stable pressurization of cylinders 52 and, subsequently, the hydraulic pressure supplied to lift cylinders 21-24 through tubes 11-14. The drive block and extruded housing can be modified to include a greater or fewer number of cylinders and their associated rods.

It will become apparent to those skilled in the art that various modifications to the preferred embodiment of the invention as described herein can be made without departing from the spirit or scope of the invention as defined by the appended claims.

The invention claimed is:

1. A drive system for controlling hydraulic cylinders used in a lift system comprising:

a housing including a screw jack having an end extending from said housing;

a thrust nut coupled to said screw jack, wherein said housing is generally rectangular and said thrust nut is shaped to slide along the inside surface of said housing, and wherein said thrust nut includes a body having a plurality of axially spaced ribs which engage an inner surface of said housing to minimise the frictional engagement of said thrust nut with said housing;

at least one hydraulic cylinder including a piston rod coupled to said thrust nut such that rotation of said screw jack provides pressure to said hydraulic cylinder, wherein said thrust nut includes an aperture extending therethrough such that an end of said piston rod can be mounted to said thrust nut and be removed by pushing said rod from a side of said thrust nut opposite the cylinder with which said piston rod is associated; and wherein said end of said screw jack is configured to receive one of a manual crank arm and a drive motor assembly for the rotation of said screw jack.

2. The drive system as defined in claim 1 wherein said thrust nut is made of a polymeric material.

3. The drive system as defined in claim 2 wherein said polymeric material is acetal.

4. A drive system for controlling hydraulic cylinders used in table lift system comprising:

a housing including a screw jack having an end extending from said housing;

a thrust nut coupled to said screw jack, wherein said housing is generally rectangular and said thrust nut is shaped to slide along the inside surface of said housing and wherein said thrust nut includes a body having a plurality of axially spaced ribs which engage an inner surface of said housing to minimize the frictional engagement of said thrust nut with said housing;

at least one hydraulic cylinder including a piston rod coupled to said thrust nut such that rotation of said screw jack provides pressure to said hydraulic cylinder and wherein said trust out includes an aperture extending therethrough such that an end of said piston rod can be mounted to said thrust nut and be removed by pushing said rod from a side of said thrust nut opposite the cylinder associated with which said piston rod is associated;

wherein said end of said screw jack is configured to receive a drive motor assembly; and a drive motor assembly coupled to said housing the rotation of said screw jack.

5. The drive system as defined in claim 4 wherein said thrust nut is made of a polymeric material.

6. The drive system as defined in claim 5 wherein said polymeric material is acetal.

* * * * *